US006027337A

United States Patent [19]

Rogers et al.

[11] Patent Number: 6,027,337

[45] Date of Patent: Feb. 22, 2000

[54] OXIDATION OVEN

[75] Inventors: James H. Rogers, Medina; Edward T. Albus, Middleburg Hts.; Philip S. Sprague, N. Olmstead, all of Ohio; Richard J. Wimberger, Depere, Wis.

[73] Assignee: C.A. Litzler Co., Inc., Cleveland, Ohio

[21] Appl. No.: 09/088,211

[22] Filed: May 29, 1998

[51] Int. Cl.[7] ..... F24F 9/00

[52] U.S. Cl. ..... 432/64; 432/59; 432/242

[58] Field of Search ..... 432/8, 59, 64, 432/152, 242; 264/29.2, 29.4, 29.5, 29.6; 423/447.1, 447.3, 447.7, 447.2

[56] References Cited

U.S. PATENT DOCUMENTS

| | | | |
|---|---|---|---|
| 3,270,655 | 9/1966 | Guirl et al. . | |
| 3,363,533 | 1/1968 | Tamm . | |
| 3,492,378 | 1/1970 | Simoncic | 432/8 |
| 3,706,138 | 12/1972 | Schuierer . | |
| 3,744,963 | 7/1973 | Flynn | 432/59 |
| 4,073,870 | 2/1978 | Saji et al. . | |
| 4,100,004 | 7/1978 | Moss et al. . | |
| 4,114,521 | 9/1978 | Busch . | |
| 4,298,341 | 11/1981 | Nowack . | |
| 4,301,136 | 11/1981 | Yamamoto et al. . | |
| 4,401,484 | 8/1983 | Yoshimoto et al. . | |
| 4,455,136 | 6/1984 | Imose et al. . | |
| 4,501,037 | 2/1985 | Lay et al. . | |
| 4,501,553 | 2/1985 | Imose et al. . | |
| 4,534,277 | 8/1985 | Gillmor . | |
| 4,534,920 | 8/1985 | Yoshinaga et al. . | |
| 4,543,241 | 9/1985 | Yoshinari et al. . | |
| 4,553,929 | 11/1985 | Kanatani et al. . | |
| 4,559,010 | 12/1985 | Katsuki et al. | 432/8 |
| 4,610,860 | 9/1986 | Mullen . | |
| 4,671,950 | 6/1987 | Ogawa et al. . | |
| 4,678,433 | 7/1987 | Ellison . | |
| 4,743,196 | 5/1988 | Imose et al. | 432/59 |
| 4,753,777 | 6/1988 | Yoshinari et al. . | |
| 5,193,996 | 3/1993 | Mullen . | |
| 5,230,460 | 7/1993 | Deamborsio et al. | 432/64 |
| 5,294,383 | 3/1994 | Donzac et al. . | |
| 5,306,209 | 4/1994 | Lang . | |
| 5,730,916 | 3/1998 | Künzel et al. . | |

*Primary Examiner*—Teresa Walberg
*Assistant Examiner*—Gregory A. Wilson
*Attorney, Agent, or Firm*—Pearne, Gordon, McCoy & Granger LLP

[57] ABSTRACT

An oxidation oven for use in the production of carbon fibers from a polyacrylonitrile precursor fiber. The oven has an oven chamber formed by sides and ends. At least one of the ends has a first opening and a second opening. The product passes through the openings for treatment in the oven chamber. The oven is also provided with a first nozzle adjacent the first opening and a second nozzle adjacent the second opening. Each nozzle is effective for discharging air from an air flow pathway into the oven chamber and forming an air curtain at the opening to which it is adjacent. An air bar defines the air flow pathway.

30 Claims, 8 Drawing Sheets

OXIDATION OVEN

BACKGROUND OF THE INVENTION

Generally, the present invention relates to ovens used in the production of fibers or webs. More specifically, the present invention relates to air seals used to contain gasses within an oxidation oven used in the production of carbon fibers.

Oxidation ovens are used in the process of making multifilament carbon fiber tows from polyacrylonitrile (PAN) precursor fibers. An example process and apparatus for making such fibers is described in U.S. Pat. No. 4,100,004 to Moss et al, incorporated herein by reference. A byproduct of the oxidation of PAN fibers is hydrogen-cyanide gas or HCN. HCN is hazardous to workers in the carbon fiber production facility and is preferably contained within the oxidation ovens until it can be properly disposed of through an exhaust system. During the production process, the fibers enter and exit the oxidation ovens many times through openings in the ends of the ovens. In the past, mechanical seals have been used to block air flow out of the oven to prevent worker exposure to HCN. However, the mechanical seals are not as effective as would be desired in blocking air flow in or out of the ovens. Accordingly, air hoods positioned over the ends of the ovens and in other work areas have been used to remove gasses escaping from the oven from the production facility.

A second concern with the prior art ovens is that cold ambient air enters the oven through the openings. This leads to the non-uniform treatment of the fibers within the oven. The result is a carbon fiber product of substandard quality. Uniform treatment of the fibers is essential to maintaining product quality.

SUMMARY OF THE INVENTION

The present invention overcomes these disadvantages by providing an oven having an oven chamber adapted to treat a product being passed therethrough. The oven chamber has sides and ends. At least one of the ends has a first opening and a second opening. The product passes through the openings for treatment in the oven chamber. The first opening is disposed above the second opening. The oven is also provided with a first nozzle adjacent the first opening and a second nozzle adjacent the second opening. Each nozzle is effective for discharging air from an air flow pathway into the oven chamber and forming an air curtain at the opening to which it is adjacent.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS OF THE INVENTION

Figure 1:
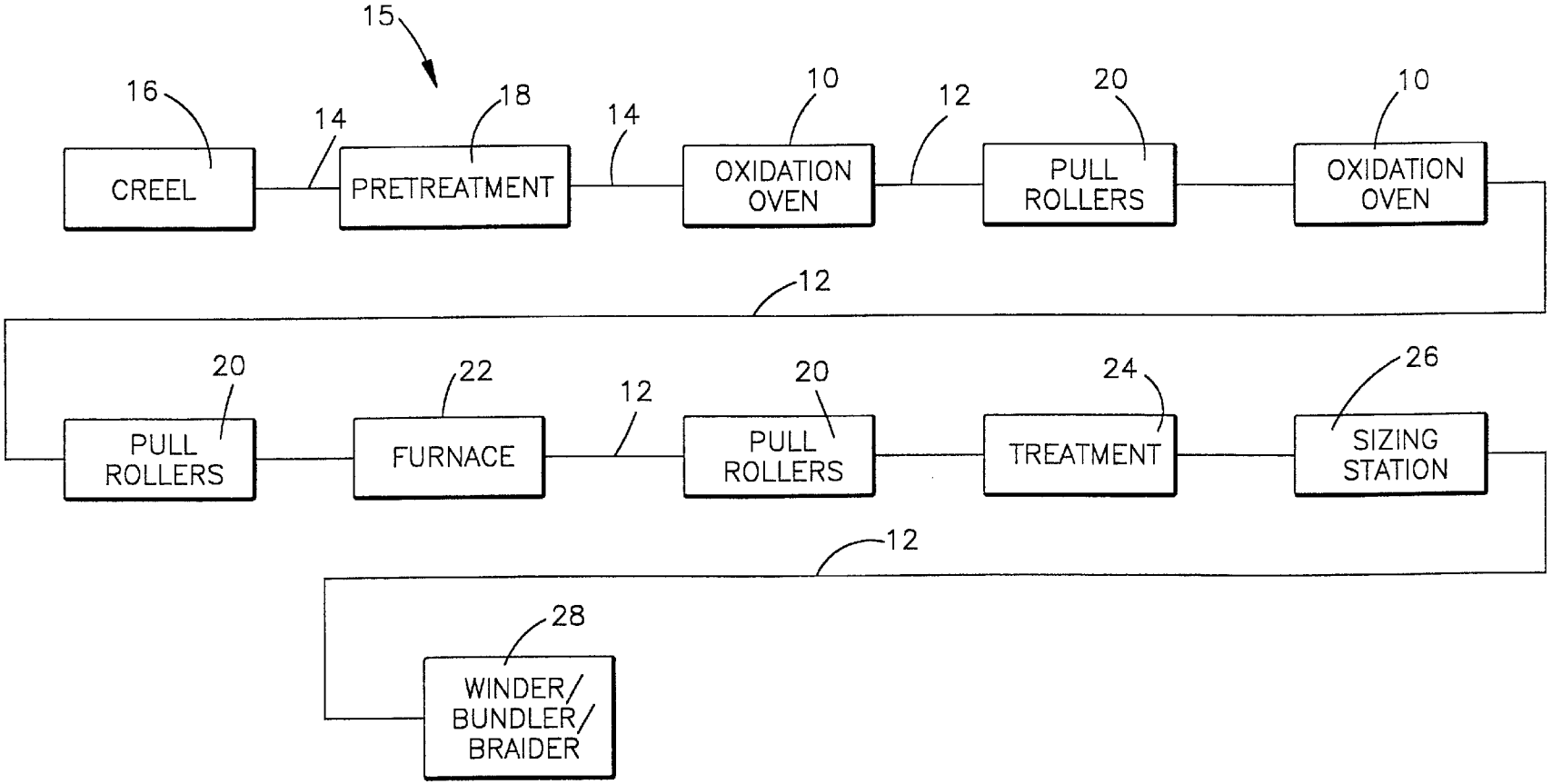
FIG. 1 shows a block diagram of a carbon fiber production facility having an oxidation oven according to the present invention.

In the detailed description which follows, identical components have been given the same reference numerals, and, in order to clearly and concisely illustrate the present invention, certain features may be shown in somewhat schematic form. When a preferred range, such as 5 to 25, is given, this means preferably at least 5 and preferably not more than 25.

Figure 2:
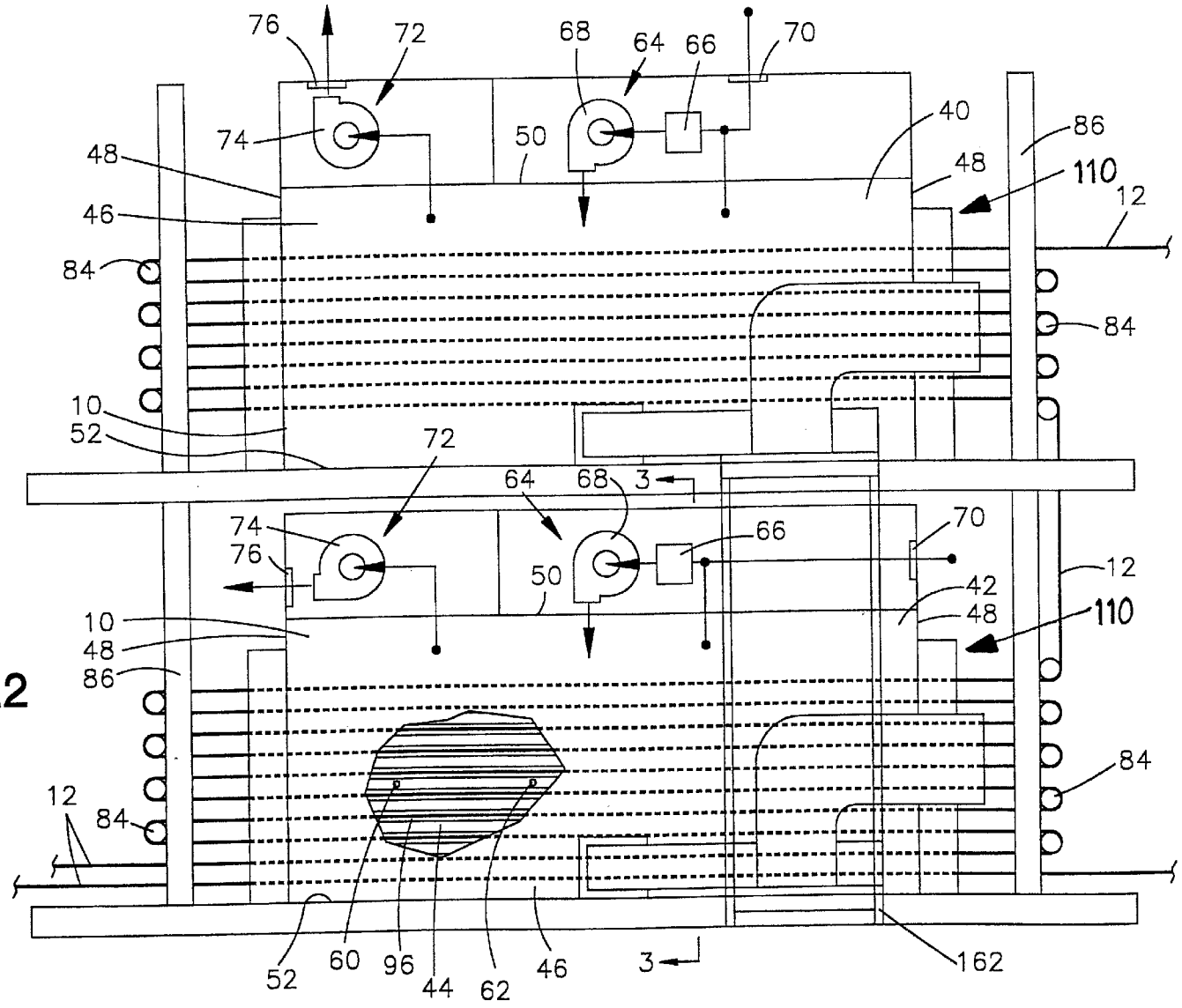
FIG. 2 is a front view of an oxidation oven according to the present invention, shown partially broken away.
Figure 3:
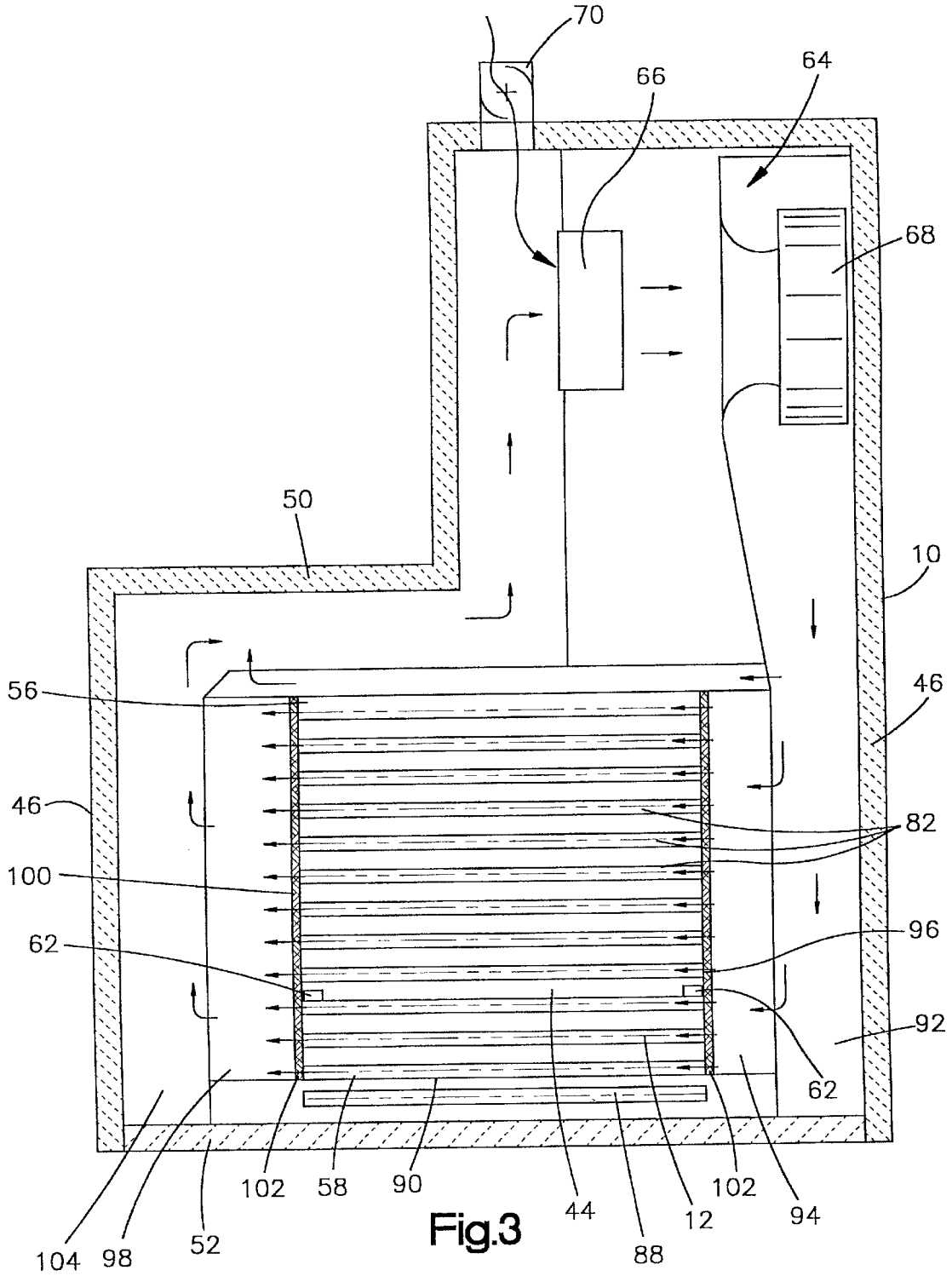
FIG. 3 is a cross sectional view of an oxidation oven according to the present invention along the line 3—3 of FIG. 2.

Referring to FIG. 1, the present invention generally relates to ovens used to treat a product. The product is typically is fibers or webs. The illustrated oven is an oxidation oven 10 used to produce carbon fiber filaments 12 from polyacrylonitrile (PAN) fibers 14, but other types of ovens and machinery are within the scope of the present invention. FIG. 1 shows, in the form of a block diagram, a typical production facility 15 for the production of carbon fibers 12. A creel 16 is used to unwind and dispense the PAN fibers 14 that are to be processed into the carbon fibers 12. Multiple PAN fibers 14 are simultaneously dispensed by the creel 16 to form sheets, bands, tows or webs of PAN fibers 14 (FIG. 3). After the PAN fibers 14 are unwound, they are passed through a pretreatment device 18, such as a tension stand having a plurality of rollers, as is well known in the art. The PAN fibers 14 are then feed into a series of oxidation ovens 10 of the present invention. The oxidation ovens 10 can be stacked in pairs (FIG. 2). Pull rollers 20 are used to draw the fibers through the ovens 10. The number of ovens 10 depends on the specific fibers being produced, the number of fibers being produced and the processing requirements for making those fibers. The structural and operational characteristics of the ovens 10 will be discussed in more detail below.

After the fibers are processed in the ovens 10 they are typically processed by one or more secondary furnaces 22. Next, the fibers 12 are treated by a treatment apparatus 24 and then a sizing station 26, which typically includes a dryer. The fibers 12 are then wound using a winder 28 and/or bundled into groups of fibers called a toe. Each toe contains hundreds or thousands of individual carbon fiber filaments 12. Multiple toes are typically braided or weaved together, often with other elements, including strength members or elastic members. As one skilled in the art will appreciate, other processing apparatus and/or additional pretreaters 18 or pull rollers 20 may be employed as needed in the production facility 15. An example production facility that includes oxidation ovens for the manufacture of carbon fibers from a PAN precursor is described in U.S. Pat. No. 4,100,004, incorporated herein by reference.

Figure 5:
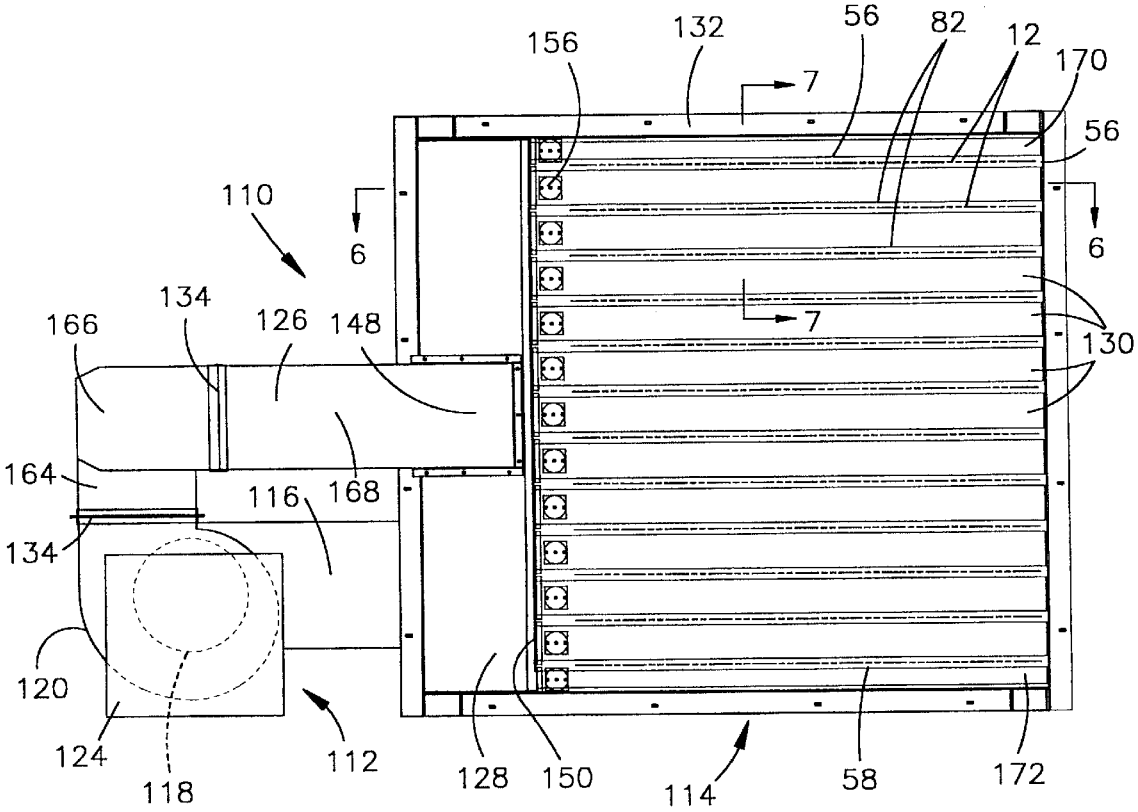
FIG. 5 is an end view of an air seal assembly according to the present invention.

Referring now to FIG. 2, a pair of oxidation ovens 10, including an upper oven 40 and a lower oven 42, is shown in stacked relationship. Each oven 10 has at least one oven chamber 44 wherein the fibers 12 are processed and treated by heated air. The oven chambers 44 are generally parallel-epipedic and are defined by side walls 46, end walls 48, a top wall 50 and a floor 52. As used herein, the lateral direction is a direction along the sides 46 of the oven 10 as shown in FIG. 2. As used herein, the horizontal direction is a direction only along the ends 48 of the oven 10 as shown in FIG. 5.

The temperature of the air in the oven chamber 44 is preferably at least 150° C. and rarely exceeds 300° C. More preferably, the nominal operating temperature of each oven 10 is 220° C. to 270° C., most preferably 235° C. to 260° C. Each oven 10 in a production facility 15 may have a different operating temperature and may also be divided, vertically or horizontally, into heating zones of different temperatures. However, each oven 10 should preferably be able to sustain the same temperature profile (i.e., temperature deviation within the oven chamber 44). A maximum temperature deviation across the horizontal width of the oven chambers 44 shall depend on the width of the oven 10, but is preferably ±5° C., more preferably ±20° C. A maximum temperature deviation from top to bottom of each oven chamber 44, specifically between the top of a top opening 56 and the bottom of a bottom opening 58 is preferably ±10° C., more preferably ±5° C. A maximum temperature deviation across the lateral width of the oven chamber 44 shall depend of the size of the oven, but is preferably ±10° C., more preferably ±5° C. The exterior oven surface temperature is preferably less than 180° F., more preferably less than 140° F.

Each oven 10, or each set of ovens, in a production facility 15, is provided with a control station. The control station is provided with digital displays for displaying temperatures in each oven chamber 44 based on temperature signals provided by a series of thermocouple probes 60 that measure temperature in the ovens 10. Selected temperature measurements are also recorded on strip charts. The control station is also provided with control circuitry for all operations of the ovens 10. The thermocouple probes 60 are disposed in thermocouple housings 62. The thermocouple housings 62 are preferably made of ¼ to ¾ inch, more preferably ¼ to ½ inch, pipe nipples that are welded into place and positioned where temperature measurements are desirable. The thermocouples housings 62 are positioned so that the thermocouple probes 60 and their housings 62 cannot contact the fiber products 12.

Referring to FIGS. 2 and 3, each oven 10 has a heater assembly 64 for heating air within the oven 10. Shown schematically, the heater assembly 64 has a heater 66 and a recirculation fan 68. As indicated by arrows (FIG. 3), air is drawn through the heater 66 by the recirculation fan 68. As the air passes through the heater 66 it is heated to a desired temperature. The recirculation fan 68 is preferably powered by an electric motor on the order of 30 to 40 HP. The heater 66 is preferably of the indirect natural gas burning type and capable of supplying heat to satisfy a heating load of 1 to 2 million BTU/hour, more preferably 1.25 to 1.5 million BTU/hour. The air heated by the heater 66 is a combination of air recirculated from inside the oven 10 and fresh air drawn in from the atmosphere through a fresh air regulator 70. Each oven also has an exhaust assembly 72 which includes an exhaust fan 74 for exhausting spent and contaminated air from inside the oven 10. The exhaust fan 74 is preferably powered by an electric motor on the order of 3 HP. The output of the exhaust fan 74 is preferably provided with a screen 76 to trap debris. Preferably, each heating zone in an oven 10 has its own heater and exhaust assemblies 64, 72. The heater and exhaust assemblies 64, 72 are disposed in housings that are provided with easily removable or openable panels for easy maintenance of the fans 68, 74 and heater 66 including the quick changing of belts, sheaves and other parts.

Each oven 10 is preferably balanced. In other words, the oven 10 exhausts air at the same mass rate that fresh air is introduced into the oven 10 through the fresh air regulator 70. Each oven 10 exhausts air at a rate of preferably 700 to 2000 standard cubic feet per minute (SCFM), more preferably 1100 to 1500 SCFM. If the oven 10 has more than one heating zone, the air is preferably exhausted from each zone at a rate of 350 to 1000 SCFM, more preferably 550 to 750 SCFM, most preferably 600 to 700 SCFM. Also, there is preferably little or no pressure differential between the overall air pressure in the oven chamber 44 and the external ambient atmosphere.

Each oven 10 has an over-all length of preferably 20 to 55 feet, more preferably 35 to 45 feet. The length of the oven chamber 44 is typically 1 to 3 feet shorter than the over-all length. The ovens 10 have an over-all width of preferably 10 to 20 feet, more preferably 12.5 to 17.5 feet. The ovens 10, without the heater and exhaust assemblies 64, 72, have a height of preferably 15 to 25 feet, more preferably 17.5 to 22.5 feet. The heater and exhaust assemblies 64, 72 are preferably placed above the ovens 10 and add about 8 feet to the height of the ovens 10. For convenience and economy of space, all of the heater and exhaust assemblies 64, 72 for a stacked pair of ovens 10 may be positioned above the upper oven 40.

The ovens 40 are constructed from panels. The panels are preferably insulated aluminized steel with tongue and groove panel to panel connections to minimize through metal heat transfer. The exterior oven surfaces are preferably painted with high temperature aluminum paint. Each oven 10 is preferably provided with an access door for permitting entrance into the oven chamber 44 for cleaning, repair, and the like. The access doors are kept shut with heavy duty, explosion proof latches. In a stacked pair of ovens 40, 42, the floor 52 of the upper oven 40 is insulated. The lower oven 42 does not need an insulated panel floor 52 so long as the oven 42 is placed on a suitable flooring, such as an insulated concrete slab.

As indicated, the fibers 12 are pulled through the oven 10 by pull rollers 20. The fibers 12 preferably travel at 800 to 1400 feet per hour (160 to 280 inches per minute), more preferably 1000 to 1200 feet per hour (200–240 inches per minute). The line speed is preferably adjustable ±50 percent. However, the speed of the fibers 12 typically does not exceed 300 inches per minute. Each pull roller 20 is provided with a line speed indicator. The speeds are displayed at the control panel(s) and selected speeds are preferably recorded on strip charts. The fiber 12 tension is preferably 50 to 300 pounds, and equals the pull force of the pull rollers 20.

As best shown in FIG. 2, the fibers 12 travel through the ovens 10 in a generally serpentine path. More specifically, the fibers 12 enter the oven chamber 44 through an opening 82 in one end 48 of the oven 10 and exit the oven chamber 44 through a corresponding opening 82 in the opposite end 48 of the oven 10. The fibers 12 are then turned using a roller 84 mounted on a roller stanchion 86, as is well known in the art. Upon turning on the roller 84, the fibers 12 then re-enter the oven chamber 44 through an opening 82 spaced above, or below depending on where the fibers 12 first entered the oven 10, the opening 82 from which the fiber 12 just exited. The fibers 12 then travel through the oven chamber 44 and exit the oven chamber 44 through another opening 82. Each time the fibers 12 enter or exit the oven 10 through an opening 82, the fibers 12 complete a pass. The number of passes is determined by the size of the oven 10 and the processing requirements of the fibers 12 being made. The number of passes per end 48 is preferably 8 to 25. Once the fibers 12 exit an oven 10 for the last time, they are drawn into the next oven 10 or through the next piece of equipment in the production facility 15 as described above. One skilled in the art will appreciate that the fibers 12 need only pass through one end 48 of the oven 10 should the fibers 12 be turned within the oven 10. Two passes, one entering and one exiting, is the practical minimum number of passes per end 48.

The diameter of each of the rollers 84 used to turn the fibers 12 is preferably 5 to 10 inches, more preferably 7 to 8 inches. Accordingly, the centers of the openings 82 are spaced apart a distance equalling the diameter of the rollers 84.

In some cases, it may be desirable for some of the fibers 12 to be processed in the production facility 15, but not by all of the ovens 10. For this purpose, the ovens 10 can be equipped with a web bypass 88. The web bypass 88 is a passage disposed under an uninsulated interior sub-floor 90 of the oven 10 so that the fibers 12 may pass only once through the oven 10 and be only minimally exposed to the heat of the oven 10.

As best shown in FIG. 3, the fibers 12 travel through the ovens 10 in a series of bands. The heated air is forced, by the recirculation fan 68, into a supply header 92. The heated air flows from the supply header 92 into a supply plenum 94 and then out of openings 96 in the interior side of the supply plenum 94 and into the oven chamber 44 where the air moves horizontally across the bands of fibers 12. After flowing across the fibers 12, the air enters a return plenum 98 through openings 100 in the interior side of the return plenum 98. Screens 102 for trapping debris are provided to cover the openings 100 in the return plenum 98 and the openings 96 in the supply plenum 94. From the return plenum 98, the air is drawn by the recirculation fan 68 through a return header 104 and then the heater 66. Fresh air enters the oven through the fresh air flow regulator 70 and mixes with the above described recycled air before reaching the heater 66. The headers 92, 104 and plenums 94, 98 used to create the air flow across the fibers can be duplicated in each oven 10 or each zone in an oven 10 to accomplish a number of goals, including matching air flow paths to the number of heater and exhaust assemblies 64, 72, creating multiple and oppositely directed air flows in each oven chamber 44 or in each heating zone, and, as will be discussed below, providing an air source for air seals made of air curtains for the openings 82.

The air flow emanating from the supply plenum 94 into the oven chamber 44 preferably flows at 100 to 800 cubic feet per minute per square foot, more preferably at 250 to 500 cubic feet per minute per square foot, and most preferably 300 to 400 cubic feet per minute per square foot. No air is circulated through the web bypass 88, should the oven be equipped with a web bypass 88.

The production of carbon fibers 12 from PAN 14 is a two step reaction. The first step is a molecular rearrangement, which is an exothermic reaction of about 500 kcal/gram. The first reaction does not require oxygen. The second step is an exothermic oxidation process of about 500 kcal/gram. The second reaction consumes oxygen. The oxygen consumption is about 10–12 percent by weight. Byproducts of the second step are carbon dioxide ($co_2$), water vapor ($H_2O$) and hydrogen-cyanide gas (HCN). HCN is toxic and must be properly disposed of. Preferably, the HCN is vented from the ovens through the exhaust assembly 72. Further treatment of the exhaust air may be required, but is not considered herein as such treatment is not part of the present invention. The quantity of HCN in the oven chamber 44 is approximately 40–80 ppm. Since the fibers 12 make passes through the ovens 10 by travelling through the openings 82, HCN may escape through the openings 82 if the openings 82 are not properly sealed. Since discharge of HCN through the openings 82 could be harmful to workers in the production facility 15, the ovens 10 are provided with seals at the openings 82 and sealed joints to minimize air from escaping in locations other than through the exhaust assembly 72.

Figure 4:
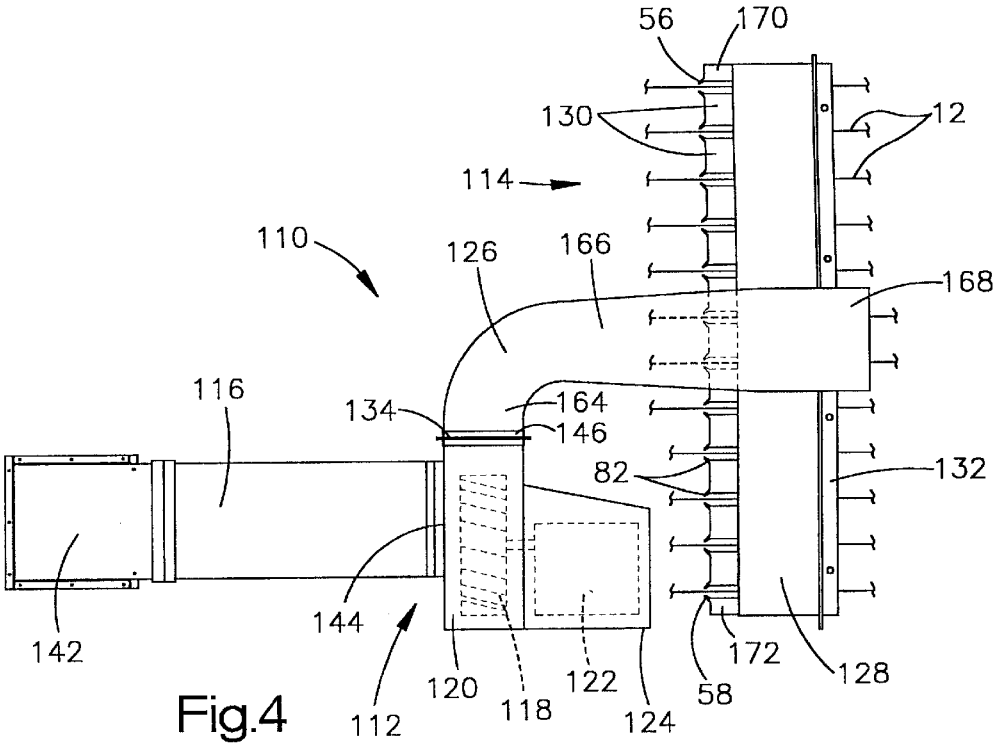
FIG. 4 is a front view of an air seal assembly according to the present invention.

Referring now to FIGS. 4 and 5, the ends 48 of the ovens 10 are provided with air seal assemblies 110 for sealing the openings 82. One air seal assembly 110 is provided for each end 48 of the oven 10. The air seal assemblies 110 are provided with an air supply subassembly 112 that supplies air from inside the oven chamber 44 to an end subassembly 114. The air supply subassembly 112 provides a return duct 116, an air seal supply fan 118 disposed in a fan housing 120 and driven by a motor 122 disposed in a motor housing 124, and an intermediate supply duct 126. The end subassembly 114 provides an air bar supply duct 128, a plurality of air bars 130 and a frame 132. Each of the ducts 116, 126 of the air supply subassembly 112 may have more than one segment. Connections between the segments and between the parts 116, 120, 126 of the air supply subassembly 112 are preferably made with collar connections 134 that are bolted together. Where desirable, such as downstream of the supply fan 118 where air pressure is high, the collar connections 134 are sealed with a bead of silicone caulk.

As will be more fully explained below, pairs of air bars 130 cooperate to form an air seal at the openings 82. The air seals are formed by a curtain of air indicated by arrows 140 (FIG. 8) to substantially prevent gasses from escaping through the openings 82. The air discharged by the air bars 130 to form the air curtain 140 is air that is recirculated from inside the oven 10. The air seal supply fan 118 draws air from inside the oven 10 through an outlet 142 that is in fluid communication with the return duct 116. The air drawn out of the oven 10 is preferably derived from the return header 104. Therefore, the outlet 142, and hence the return duct 116, is in fluid communication with the return header 104. The air is drawn through the return duct 116, through a fan input opening 144, into the fan housing 120 and then forced, by the impeller of the fan 118, through a fan output opening 146 into the intermediate supply duct 126. After traveling through the intermediate supply duct 126, the air travels through an inlet opening 148 of the air bar supply duct 128 and into the air bar supply duct 128. The air bar supply duct 128 is provided with a plurality of outputs 150. Each air bar supply duct output 150 is in fluid communication with one of the air bars 130 so that air is distributed from the air bar supply duct 128 to each of the air bars 130. The flow of air from the air bar supply duct 128 to the air bars 130 is regulated by an adjustable damper 156 provided on each air bar 130. Once in the air bar 130, the air is forced through a pressure drop screen 158 and then discharged into the oven chamber 44 through nozzles 160. The term nozzle, as used herein, need not require a taper or constriction to change air velocity. The pressure drop screen 158 serves to distribute air in a substantially uniform manner along the horizontal length of the air bar 130, and will be described in greater detail below.

Since the air used for the air seals is hot air recirculated from the oven 10, the ducts 116, 126 and fan housing 120 are provided with thermal insulation to reduce heat loss as the air passes through the air supply subassembly 112 to the air bars 130. This way, the air curtain 140 will be made of heated air that is almost the temperature of the air within the oven chamber 44. The fan and motor housings 120, 124 are preferably provided with easily removable or openable panels for easy maintenance of the fan 118 and motor 122 including the quick changing of belts, sheaves and other parts.

Air flow sensors are preferably provided in the air paths associated with the air seal supply fan 118, the recirculation fan 68, and the exhaust fan 74. Should air flow stop in any of these air paths, the sensors will send a signal to an alarm. The alarm will alert the operator to the failure so that corrective action can be taken. Corrective action can include repairing equipment while the production facility 15 is still operating or shutting down equipment in the production facility 15 until repairs can be made. In any event, corrective action must be done in accordance with set procedures in order to prevent fires, hazardous conditions, product loss, and the like. Accordingly, the production facility 15 can be provided with a back-up air removal hood positioned over at least the ends 48 of the ovens 10. Alternatively, the air paths may be provided with redundant equipment that will operate in the event of a failure.

As stated, the overall air pressure inside the oven 10, preferably measured at the bottom of the oven chamber 44, is substantially equivalent to the air pressure of the atmosphere outside the oven 10. In addition, since hot gasses rise, there is typically a temperature differential inside the oven chamber 44 from bottom to top. Although this temperature differential is minimized in the present oven 10, the temperature differential results in a chimney effect inside the oven 10. The result of the chimney effect is a pressure differential inside the oven 10 from bottom to top. The air pressure at the top of the oven 10 would be higher than the air pressure at the bottom of the oven 10. The air pressure at the top would also be positive with respect to the outside atmosphere and the air pressure at the bottom of the oven 10 would be negative or balanced with respect to the outside atmosphere. The chimney effect is quantifiable, but will vary based on the height and operating temperature of the oven 10. Assuming a normally static air pressure at the openings 82, the chimney effect would result in air from the atmosphere being drawn into the oven chamber 44 through the lower openings 56, 82 and air from the oven chamber 44 being expelled to the atmosphere through the upper openings 58, 82. However, the air curtain 140 substantially blocks any air flow that would otherwise result from the chimney effect. Therefore, the air curtain 140 is effective to substantially prevent the escape of harmful gasses from the oven chamber 44 into the atmosphere surrounding the oven 10 through the openings 82, whether the oven 10 is balanced, as discussed above, or unbalanced.

Referring to FIGS. 1, 4 and 5, the outlet 142 from the oven 10 to the return duct 116 is preferably 0.1 to 0.4 square meters, more preferably 0.2 to 0.3 square meters. The return duct 116 has a corresponding cross sectional size. The fan and motor housings 120, 124 are mounted on an air supply subassembly support frame 162. When a pair of ovens 40, 42 are stacked, the fan and motor housings 120, 124 are preferably mounted on the same support frame 162 and aligned vertically. The relative locations of the outlets 42 in the lower and upper ovens 42, 40, and their distances from their respective fan housings 120 will be dictated by the location of the return headers 104 inside the oven 10. In the example embodiment, the outlets 142 in the lower oven 42 and upper oven 40 are preferably offset from one another in the lateral direction. The distance from the center of the outlet 142 of the lower oven 42 to the center of the lower oven fan housing 120 is preferably 1 to 5 meters, more preferably 1.5 to 3 meters. The distance from the center of the outlet 142 of the upper oven 140 to the center of the upper oven fan housing 120 is preferably 0.25 to 4 meters, more preferably 0.5 to 2 meters.

The outlet 146 of the fan housing 120 is preferably 0.1 to 0.4 square meters, more preferably 0.15 to 0.25 square meters. The intermediate supply duct 126 has a corresponding cross sectional size. As illustrated, the intermediate supply duct 126 has three main sections, including a vertically extending section 164, a laterally extending section 166 and a horizontally extending section 168. The vertically extending section 164 preferably extends from the output 146 of the fan housing 120, 0.25 to 0.75 meters, more preferably 0.4 to 0.5 meters, measured from the output 146 of the fan housing 120 to the vertical center of the laterally extending section 166. The laterally extending section 166 is preferably 1 to 2 meters long, more preferably 1.3 to 1.6 meters long, measured from the lateral center of the fan housing 120 to the lateral center of the horizontally extending section 168. The horizontally extending section 168 is preferably 1 to 2.5 meters long, more preferably 1.5 to 2 meters long, measured from the horizontal center of the laterally extending section 166 to the center of the inlet opening 148 to the air bar supply duct 128. The inlet opening 148 is preferably 0.1 to 0.5 square meters, more preferably 0.2 to 0.3 square meters. The air bar supply duct 128 preferably measures 0.1 to 0.35 meters, more preferably 0.2 to 0.3 meters, in the lateral direction and measures 0.25 to 1.0 meters, more preferably 0.35 to 0.65 meters, in the horizontal direction. Preferably, the outlet opening 142, fan inlet 144, the fan outlet 146, the inlet opening 148 and the air supply subassembly ducts 116, 126 have a rectangular shaped cross section. The bends and turns in the ducts 116, 126 can be either angled or curved. The ducts 116, 126 may also be tapered as needed to connect the components of the air supply subassembly 112 together. As one skilled in the art will appreciate, the shapes and sizes identified above can be widely varied while obtaining equivalent results. Fan 118 size and fan motor 122 power will also vary. The most important factor in determining these parameters is air flow out of the nozzles 160.

Figure 6:
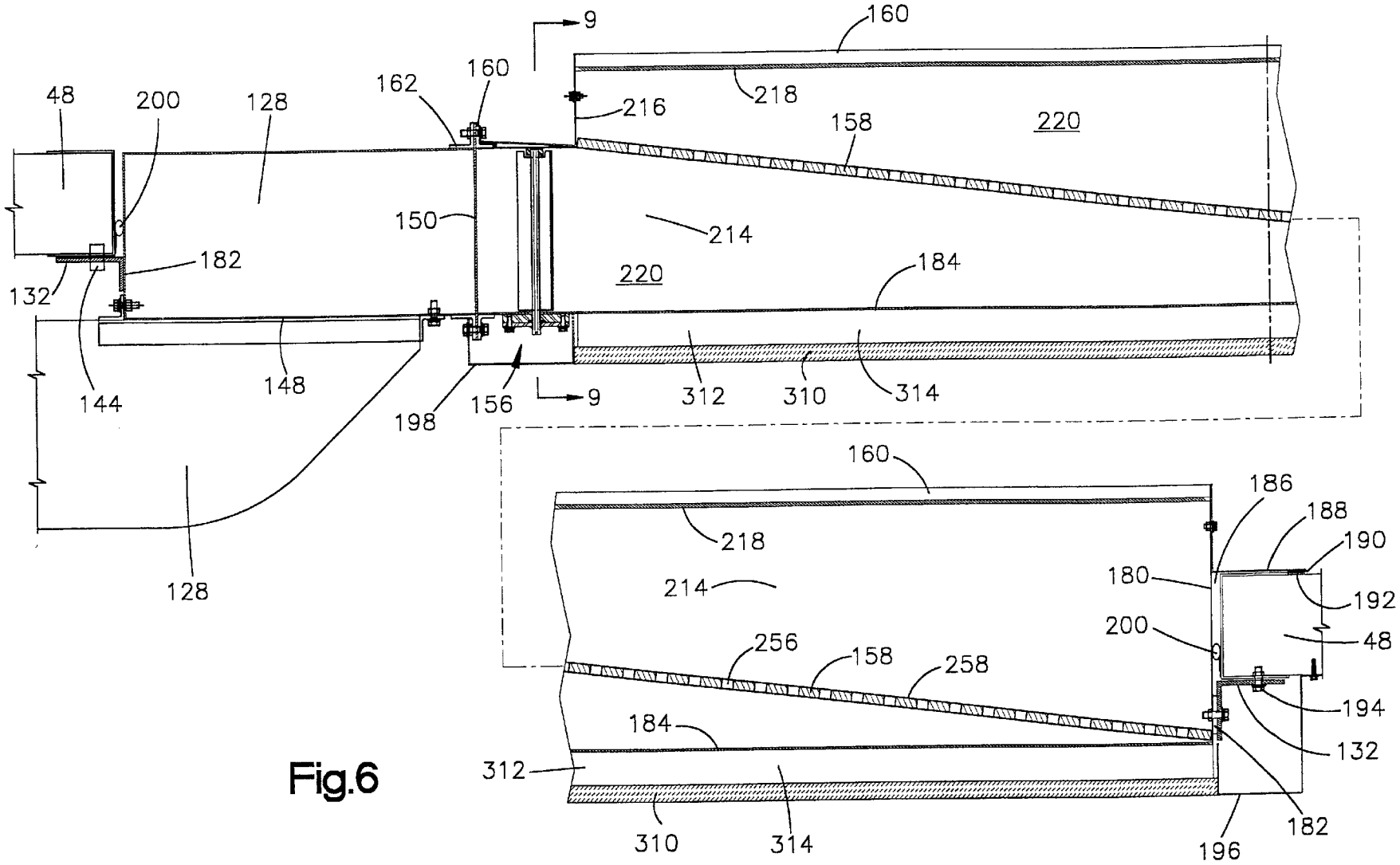
FIG. 6 is a cross sectional view of an air seal according to the present invention along the line 6—6 of FIG. 5.

As noted, the end subassembly 114 is provided with a rectangular frame 132 for supporting the air bar supply duct 128 and the air bars 130. The frame 132 is preferably made from metal angles. With further reference to FIGS. 6 and 7, the frame 132 is preferably bolted to the air bar supply duct 128, a top air bar 170, a bottom air bar 172, and a closed end 180 of all of the air bars 130. A gasket 182 is preferably placed between the frame 132 and the air bar supply duct 128/air bars 130. The gasket 182 helps to form a substantially air tight seal. As one skilled in the art will appreciate, the air bar supply duct 128 need not be mounted in the frame 132. Rather, the air bars 130 could transverse the entire horizontal dimension of the frame 132 and the air bar supply duct 128 could be secured to an outer side 184 of the air bars 130.

The end subassembly 114 can be attached to the oven 10 as a single unit. Preferably, each end 48 of the oven 10 has an aperture 186 for allowing entry of the fibers 12 into the oven chamber 44. Each aperture 186 requires an air seal assembly 110. Accordingly, the apertures 186 are adapted to received the end subassembly 114. For simplicity, the figures show only one air supply subassembly 112 per oven 10. The air supply subassemblies 112 are typically located on opposite sides 46 of the oven 10, depending on the locations of the return headers 104. Bolted to the closed ends 180 of the air bars 130 is an angle bracket 188 for engaging the interior side of the end wall 48 of the oven 10 to provide added support and air-tightness. An outer edge 190 of the angle bracket 188 is folded over on itself to form a hem 192 so that no sharp edges are presented to the oven end wall 48 as the end assembly 114 is being installed. As illustrated in FIG. 6, the frame 132 is bolted and screwed to the oven end wall 48, the air bar supply duct 128 and air bars 130. Holes 194 are provided in the frame to accommodate the bolts and screws. The holes 194 are preferably horizontal and/or vertical slots to allow the parts to move slightly with respect to each other as they expand or contract due to thermal expansion. As illustrated, additional pieces of sheet metal 196, 198 are preferably used to prevent air leakage between the end subassembly 114 and the oven 10 and between the air bar supply duct 128 and the air bars 130.

A seal 200 is placed around the periphery of the aperture 186 in the oven end wall 48 to minimize air leakage between the oven end wall 48 and the air bar supply duct 128 and the air bars 130. The seal 200 preferably has a rounded body 204, such as circular-shaped, elliptical-shaped or oval-shaped, and has a wing 206 integrally formed with the body 206. The body 206 provides a seal means for preventing air leaks between the end subassembly 114 and the oven end wall 48 and the wing 206 is used for attachment of the seal 200 to the oven end wall 48. The body 204 and wing 206 are preferably made of glass impregnated silicone. The body 204 is provided with a wire core 208 for support. As the end subassembly 114 and the oven 10 expand and contract due to thermal expansion, the body 204 of the seal 200 will compress and expand to minimize air leakage thereby providing a compressible seal means.

Figure 7A:
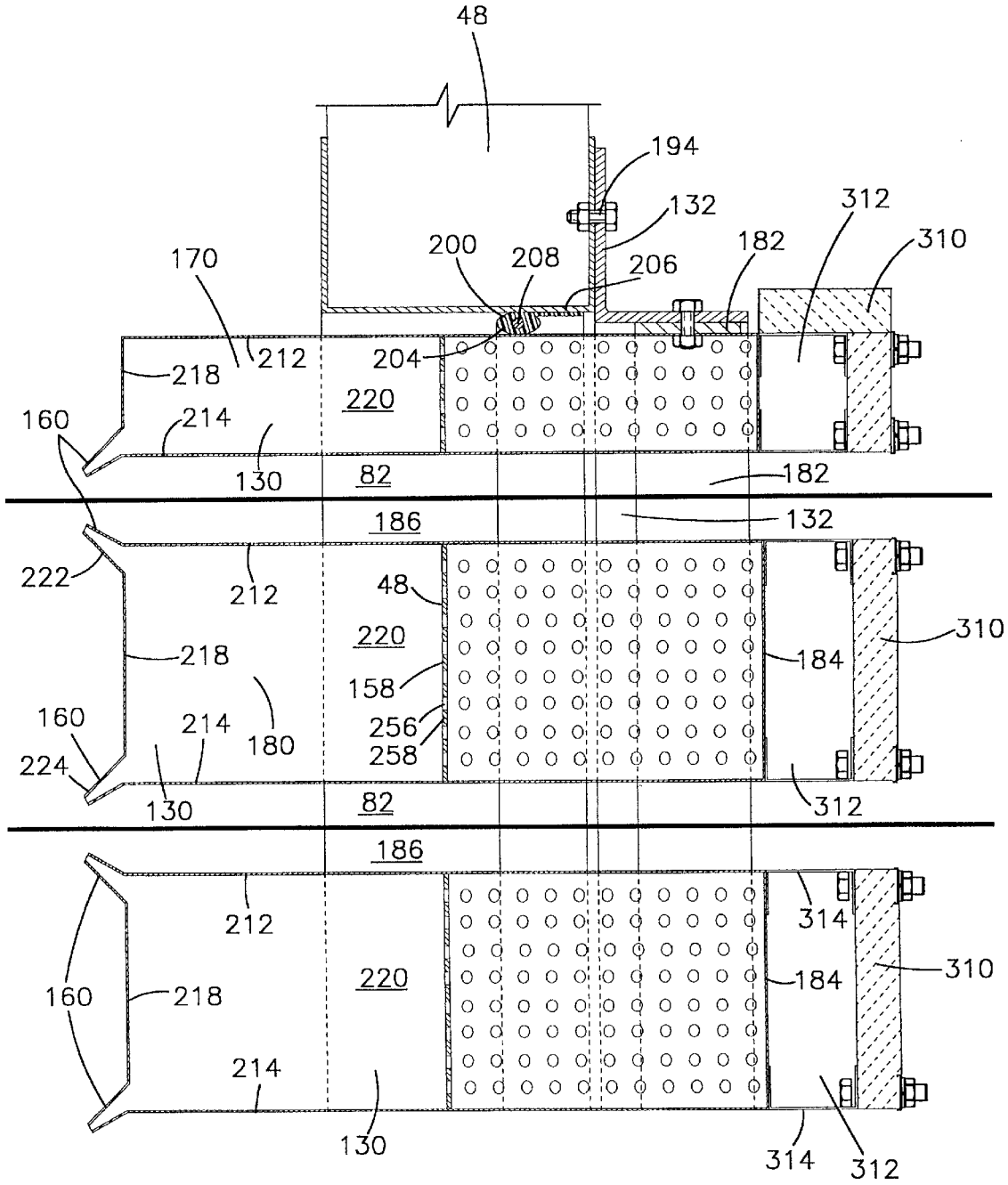
FIG. 7*a* is a cross sectional view of a series of air bars according to a first embodiment of the present invention along the line 7—7 of FIG. 5.
Figure 7B:
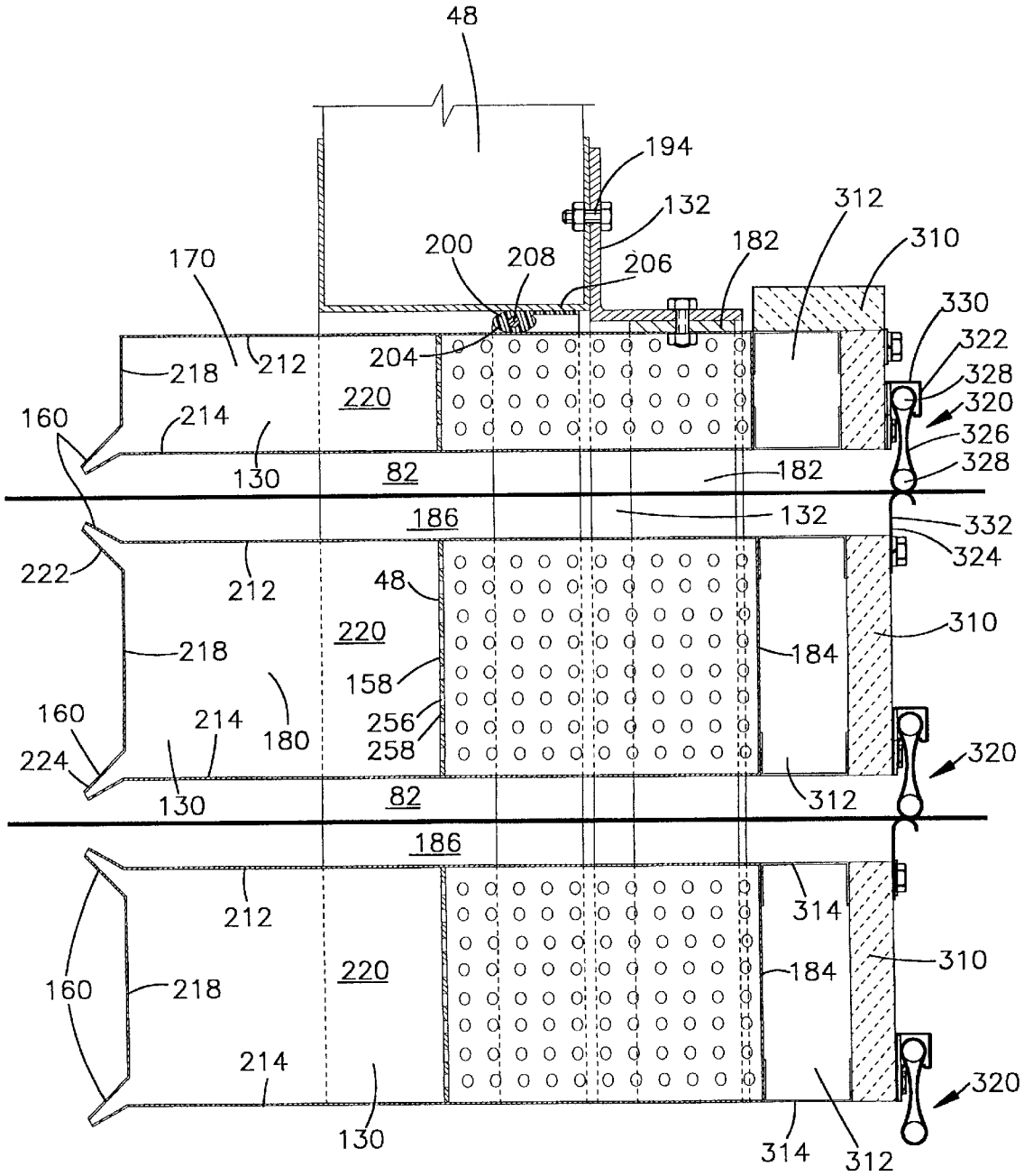
FIG. 7*b* is a cross sectional view of a series of air bars according to a second embodiment of the present invention along the line 7—7 of FIG. 5.
Figure 8:
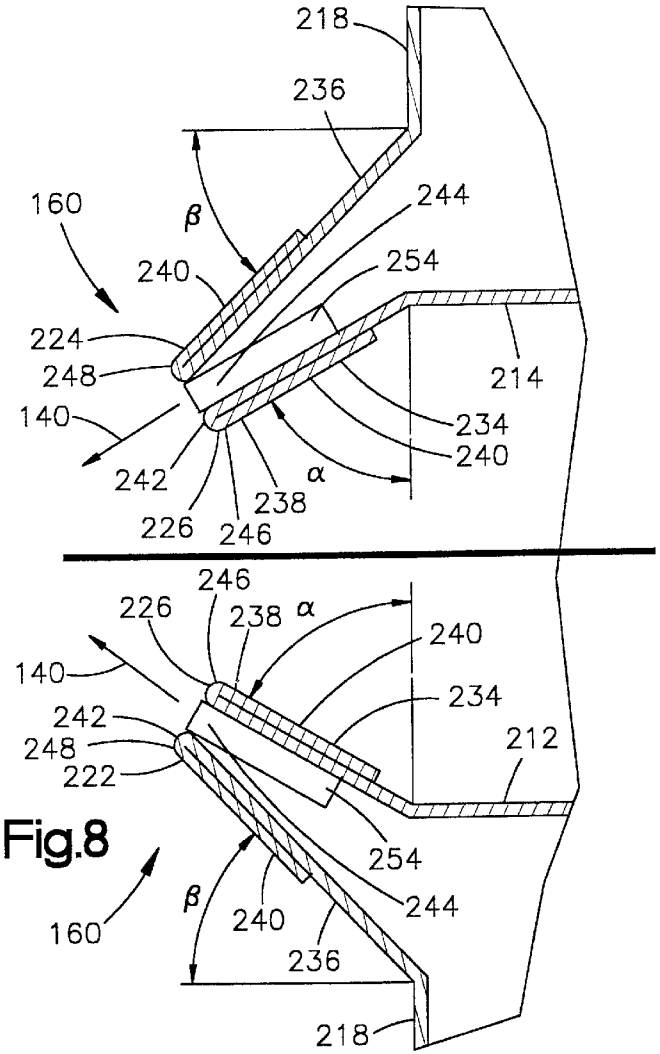
FIG. 8 is an enlarged cross sectional view of a pair of nozzles according to the present invention.

Air bars 130, according to a first embodiment of the invention, are shown in detail in FIGS. 6, 7*a* and 8. The air bars 130 are preferably made of 14 to 22 gauge, more preferably 16 to 20 gauge, most preferably 18 gauge, aluminized steel. The air bars 130 may also be made from stainless steel, milled steel or COR-TEN brand steel from United States Steel Corporation. Each air bar 130 has a top 212, a bottom 214, the closed end 180, a supply end 216, a nozzle side 218 and the outer side 184 to define an air flow pathway 220. The space between the bottom 214 of one air bar 130 and the top 212 of an adjacent air bar 130 define the openings 82 that the fibers 12 enter and exit the oven 10 through. As shown in FIGS. 4, 5, 7*a*, 7*b* and 8, there is an air bar 130 adjacent the openings 82. Also shown in these figures is product, in the form of fibers 12, passing through the openings 82 and the openings 82 being sealed by an air curtain 140. Each air bar 130, except for the top air bar 170 and the bottom air bar 172 are provided with a pair of nozzles 160, one upwardly projecting 222 and one downwardly projecting 224. The top air bar 170 is provided with one downwardly projecting nozzle 224 and the bottom air bar 172 is provided with one upwardly projecting nozzle 222. The top air bar 170 is shown in FIGS. 7*a* and 7*b*. The bottom air bar 172 is a mirror image thereof. As air is discharged from the nozzles 160 and into the oven chamber 44, adjacent pairs of nozzles 226 cooperate to form the air curtain 140. The air curtain 140 acts as the air seal for each opening 82. Although two cooperating nozzles 226 are preferred, one skilled in the art will appreciate that one upwardly projecting nozzle 222 or one downwardly projecting nozzle 224 by itself will create an air curtain 140 sufficient to form an air seal over the openings 82. In such an alternative arrangement, top air bar 170 and/or bottom air bar 172 can be eliminated and/or the air bars 130 can be provided with a single nozzle 160. In another alternative arrangement, multiple upwardly projecting nozzles 222 and/or downwardly projecting nozzles 224 can be provided at the openings 82 to create the air curtain 140.

With continuing reference to FIG. 8, the nozzles 160 have a proximal side 234 closest to the fibers 12 and a distal side 236 farthest from the fibers 12. The proximal side 234 of an upwardly projecting nozzle 222 is part of the sheet metal material of the top side 212 of the air bar 130 that is bent so as to form an angle $\alpha$ from vertical. The proximal side 234 of a downwardly projecting nozzle 224 is part of the sheet metal material of the bottom side 214 of the air bar 130 that is bent so as to also form an angle $\alpha$ from vertical. The angle $\alpha$ is preferably 45 to 85 degrees, more preferably 50 to 70 degrees, most preferably 60 to 65 degrees. The distal side 236 of both the upwardly and downwardly projecting nozzles 222, 224 is part of the sheet metal material of the nozzle side 218 of the air bar 130 that is bent so as to form an angle $\beta$ from horizontal. The angle $\beta$ is preferably 30 to 60 degrees, more preferably 35 to 55 degrees, most preferably 40 to 50 degrees. These angles are selected so that air exiting the nozzles 160 will cooperate to form the air seal (air curtain 140) to prevent air from exiting or entering the oven 10 at the openings 82, but also so that the air will not damage the passing fibers 12.

Both the proximal and distal sides 234, 236 have leading edges 238 that are bent over on themselves to form a hem 240. The hem 240 provides rounded tips 242 to the proximal and distal sides 234, 236 so that no sharp edges are presented to the fibers 12. The length of the proximal side 234 is preferably 1 to 5 cm, more preferably 1.5 to 3 cm, most preferably 2 to 3 cm. The length of the hem 240 on the proximal side 234 is preferably 60 to 85 percent, more preferably 70 to 75 percent, of the length of the proximal side 234. The length of the distal side 236 is preferably 1.5 to 6 cm, more preferably 2 to 4.5 cm, most preferably 3 to 3.75 cm. The length of the hem 240 on the distal side 236 is preferably 40 to 70 percent, more preferably 50 to 60 percent, of the length of the distal side 236. The hems 240 for both sides 234, 236 are preferably 1.5 to 2.25 cm long, more preferably 1.85 to 1.95 cm long.

A gap 244 is formed between the tip of the proximal side 246 and the tip of the distal side 248 of each nozzle 160. Air forming the air curtain 140 is discharged from the air bars 130 through the gap 244. The gap 244 has a gap width that when measured from proximal tip 246 to distal tip 248 is preferably 0.1 to 0.5 cm wide, more preferably 0.25 to 0.35 cm wide. Spacers 254 are provided between the proximal tip 246 and the distal tip 248 to maintain the gap width. The spacers 254 are preferably cylindrical bodies that are welded or otherwise attached to an interior surface of the proximal sides 234. The diameter of the spacer 254 preferably equals the gap width. The spacers 254 are preferably spaced apart every 6 to 24 inches, more preferably every 12 inches along the length of the air bar 130.

The overall length of the air bar 130 measured along the nozzle 160 will depend on the size of the oven 10, but is preferably 48 inches to 108 inches, more preferably 60 to 84 inches long. The height of the air bar 130 will depend on the diameter of the rollers 84, but is, excluding the height of the nozzles 160, preferably 3 to 7 inches high, more preferably 5 to 6 inches high. The height of the openings 82, measured from the top 212 of an air bar 130 to the bottom 214 of an adjacent air bar 130 is preferably 1 to 3.5 inches, more preferably 1.5 to 3 inches, most preferably 2 to 2.5 inches. The distance from the tip of an upwardly projecting proximal side 234 to the tip of an adjacent downwardly projecting proximal side 234 is 0.75 to 3 inches, more preferably 1 to 2 inches, most preferably 1.25 to 1.75 inches. Cooperating pairs of nozzles 226 that form an air seal are generally parallel with one another. The fibers 12 preferably travel equidistant from the two nozzles 160 forming the pairs 226 and two air bars 130 that define the opening 82.

With continued reference to FIG. 6 and 7*a*, each air bar 130 is provided with a diffuser sheet, or pressure drop screen 158. The pressure drop screen 158 is preferably a piece of sheet metal material made of the same material and thickness as the sheet metal material of the air bars 130. The pressure drop screen 158 is provided with holes 256 to allow air to pass through the screen 158. A solid area 258 of the screen 158 acts to distribute the air along the length of the air bar 130 so that air exiting the nozzle 160 will treat the fibers 12 in a substantially uniform manner. The diameter of the holes 256 are preferably 0.25 to 1.5 inches, more preferably 0.33 to 0.66 inches. The holes 256 define a total open area of the pressure drop screen 158 that is preferably 30 to 65 percent, more preferably 45 to 55 percent, of the total area of the screen 158. The pressure drop screen 158 is preferably stitch welded into place as illustrated. As one skilled in the art will appreciate, the screen 158 can be replaced with a mesh material, a perforated plate, a screen webbing or an upstream opening which is of reduced or smaller size to produce a pressure drop, with equivalent results and all being means to create the desired air distribution.

The supply end 216 of the air bar 130 is connected to and in fluid communication with the air bar supply duct 128. Preferably the supply end 216 is provided with a flange 260 that is screwed, bolted, welded or otherwise secured to a corresponding flange 262 on the air bar supply duct 128. This junction is preferably made air tight with the assistance of a bead of caulk or a gasket. With the exception of the nozzles 160, the air bar 130 itself is preferably air tight.

Figure 9:
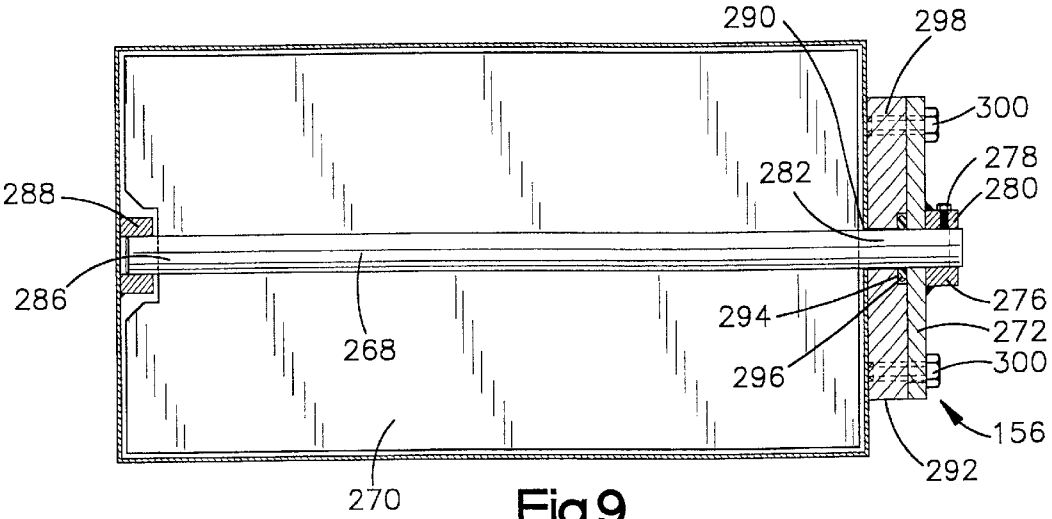
FIG. 9 is a cross sectional view of an air damper according to the present invention along the line 9—9 of FIG. 6.
Figure 10:
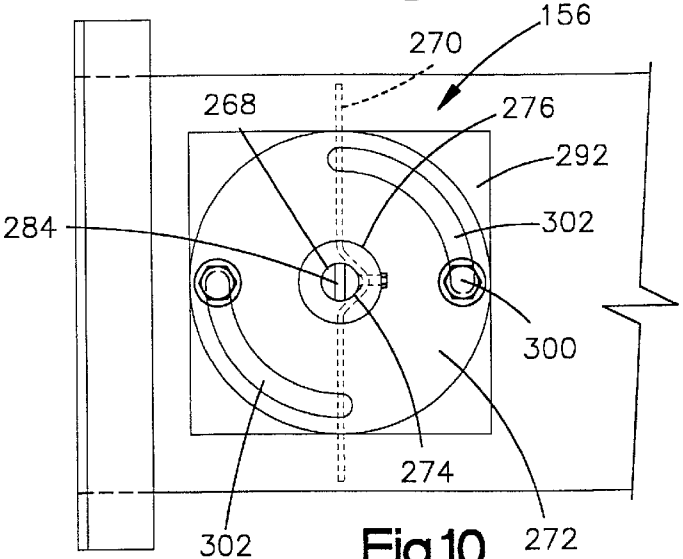
FIG. 10 is an enlarged front view of an air damper according to the present invention.

With further reference to FIGS. 9 and 10, the supply ends 216 of each of the air bars 130 are provided with individually adjustable dampers 156 for regulating the air flow from the air bar supply duct 128 into the air bars 130. The dampers 156 are provided with a shaft 268, a damper blade 270, and an adjustment disk 272. The blade 270 is a generally planar piece of sheet metal material, preferably made from 12 to 18 gauge aluminized steel. The blade 270 is sized so that when it is positioned vertically in the air bar 130, it will occupy almost all of the cross sectional area of the air bar 130 to substantially prevent air from entering the air bar 130 from the air supply duct 128. The blade 270 is provided with a semicircular ridge 274 for receiving the shaft 268. The blade 270 and the shaft 268 are preferably welded together. The adjustment disk 272 is provided with a steel set collar 276 having a set-screw 278 that attaches the disk 272 to the shaft 268 by tightening against a flat 280 provided on an outer end 282 of the shaft 268. The outer end 282 of the shaft 268 is also provided with a slot 284. The slot 284 is sized to receive a screw driver for rotary adjustment of the damper 156.

The shaft 268 is mounted, at an inner end 286, to the air bar 130 by a shaft collar 288 that is preferably tack welded to the inside of the air bar 130. The outer end 282 extends through a hole 290 provided in the air bar 130 and through an outer collar 292 that is preferably stitch welded to the exterior of the air bar 130. The outer collar 292 is sealed with silicone to minimize air leaks between the air bar 130 and the outer collar 292. The outer collar 292 is provided with a radial channel 294 for receiving a silicone o-ring seal 296 to minimize air leaks between the shaft 268 and outer collar 292 and between the outer collar 292 and the adjustment disk 272. The outer collar 292 is also provided with a pair of holes 298 for receiving lock down screws 300. The adjustment disk 272 is provided with a pair of radial slots 302, through which the lock down screws 300 extend. After the damper 156 is adjusted, the lock down screws 300 are tightened, thus preventing further rotation of the damper adjustment disk 272, shaft 268 and blade 270.

Referring again the FIGS. 6 and 7*a*, the air bars 130 are preferably provided with an insulator 310. The insulator 310 is attached to a spacer 312 made from a pair of brackets 314 that are attached, preferably by welding, to the outer side 184 of the air bar 130. The insulator 310 is preferably held to the spacer brackets 314 with nuts and bolts. The insulator 310 is preferably made of ceramic or any other suitable material. The spacer 312 separates the insulator 310 from the outer side 184 of the air bar 130 a distance of preferably 1 to 3 inches, more preferably 1.75 to 2.25 inches. The insulator 310 preferably has a height equally the height of the air bar 130. The thickness of the insulator 310 is dependent on the material it is made from. For a ceramic insulator 310, the thickness is preferably 0.5 to 1.5 inches. more preferably 0.75 to 1.25 inches.

The flow of air out of the nozzles 160 must be powerful enough to contain the gasses within the oven 10, but not so powerful that the air flow will damage the fibers or disrupt their travel. The air flow velocity out of each of the nozzles 160 is preferably 500 to 5000 feet per minute (FPM), more preferably 1500 to 3500 FPM, most preferably 2000 to 3000 FPM. The flux of air exiting the nozzles 160, or amount of air per unit area defined by the equation flux=flow rate (in cubic feet per minute)÷area, will depend on the velocity of the air and opening area of the nozzle 160. As an example, a typical nozzle 160 will discharge air at a rate of 2600 FPM through a nozzle gap 244, or opening, of ⅛ inch and a length of 72 inches. The area of the nozzle 160 opening for this size nozzle is 9 square inches, resulting in an air flux of about 18 cubic feet per minute per square inch. The air flux is preferably 4 to 35, more preferably 10 to 24, most preferably 14 to 21, cubic feet per minute per square inch. Preferably, the quantity of air drawn into the oven 10 through the openings 82 as a result of a venturi effect caused by the air curtain 140 is minimized or eliminated. This is accomplished by adjustment of dampers 156 to achieve proper air velocity exiting from the nozzles 160 to balance any air pressure differential between the oven chamber 44 and the outside atmosphere.

Referring now to FIG. 7*b*, a second embodiment of the present invention is illustrated. The second embodiment adds mechanical seals 320 to the oven 10. The mechanical seals 320 themselves are conventional and are an optional feature of the present invention. The mechanical seals 320 are provided with two sealing members 322, 324. The first sealing member 322 minimizes air from escaping from the oven 10 above the fibers 12 and the second sealing member 224 minimizes air from escaping below the fibers 12. The first sealing member 322 is provided with a strip of cloth 326 made from high temperature material. The cloth 326 is preferably of a weave that will minimize airflow therethrough. The strip of cloth 326 is looped around two metal rods 328 as illustrated. A clip 330 is used to hold the cloth 326 and one of the metal rods 328. The clip 330 is bolted or otherwise secured to the lower part of the insulator 310. The other rod 328 is used to weight the cloth 326 so that it contacts the fibers 12 or dangles just above them. The second sealing member 324 is a curved piece of metal 332, preferably stainless steel, which is bolted or otherwise secured to the upper part of the insulator 310.

Although particular embodiments of the invention have been described in detail, it is understood that the invention is not limited correspondingly in scope, but includes all changes and modifications coming within the spirit and terms of the claims appended hereto. For example, the nozzle 160 can be, and is herein defined to include, a simple opening, vent, slit, or array of holes in the air bar 130 without a projecting component. The nozzles 160 can also be, and is herein defined to include, a curved surface or a series of flat surfaces (e.g., the sides of an octagon) that air is directed around. Alternatively, the air bar 130 can be eliminated and the nozzle 160 alone can be disposed adjacent the opening 82. Accordingly, the air flow pathway 220 will be defined by the alternative structure used to create an alternative supply air flow pathway. In addition, alternatives to the preferred embodiment of having air bars 130 to define openings 82 in an aperture 186 are plausible. These alternatives include, but are not limited to, providing openings 82 or slits in an end wall 48 or in an end covering for the passage of fibers 12.

We claim:

1. An oven comprising, an oven chamber adapted to treat a fiber or web being passed therethrough, said oven chamber having a top, a bottom, two sides and two ends, at least one of said ends having a first opening and a second opening for said fiber or web to pass therethrough for treatment in said oven chamber, said first opening being disposed above said second opening, and a first nozzle adjacent said first opening, a second nozzle adjacent said second opening, each of said first and second nozzles being effective for discharging air from an air flow pathway into said oven chamber and forming an air curtain at the opening to which it is adjacent, said air curtains cooperating to substantially prevent a chimney effect between said first and second openings.

2. The oven according to claim 1, said air curtain being effective to substantially prevent escape of harmful gasses from said oven chamber into an atmosphere outside said oven.

3. The oven according to claim 1, wherein each of said first and second nozzles are associated with and in fluid communication with an air bar, said air bar defining said air flow pathway.

4. The oven according to claim 1, wherein said first nozzle is associated with a first air bar defining a first air flow pathway and said second nozzle is associated with a second air bar defining a second air flow pathway.

5. The oven according to claim 1, wherein said oven is an oxidation oven to oxidize said fiber or web.

6. The oven according to claim 5, wherein said oven oxidizes a polyacrylonitrile precursor fiber into a carbon fiber filament.

7. The oven according to claim 5, wherein a nominal operating temperature of said oven is 220° C. and 270° C.

8. The oven according to claim 5, wherein a maximum temperature deviation across a horizontal width of said oven chamber is ±5° C., a maximum temperature deviation from a top of a top opening to a bottom of a bottom opening is ±10° C., and a maximum temperature deviation from one end of said oven chamber to the other end of said oven chamber is ±10° C.

9. The oven according to claim 1, wherein said oven has two ends and said fiber or web passes through both ends for treatment in said oven chamber.

10. The oven according to claim 9, wherein a path of said fiber or web passing through said oven is serpentine shaped.

11. The oven according to claim 9, wherein said air bar is provided with a pressure drop means adapted to distribute air in said air bar.

12. The oven according to claim 9, wherein said air bar has a damper adapted to regulate air flow into said air flow pathway.

13. The oven according to claim 1, wherein said air flow pathway is defined by an air bar.

14. The oven according to claim 13, wherein said first nozzle is an upwardly projecting nozzle disposed on said air bar and said second nozzle is a downwardly projecting nozzle disposed on said air bar.

15. The oven according to claim 13, further comprising a seal disposed on said air bar, said seal having a body and a wing integrally formed with said body, said body providing a compressible seal means.

16. The oven according to claim 13, wherein said air bars are made from aluminized steel sheets.

17. The oven according to claim 1, further comprising a third nozzle adjacent said first opening, and a forth nozzle adjacent said second opening, said first and third nozzles cooperating to form said air curtain for said first opening and said second and forth nozzles cooperating to form said air curtain for said second opening.

18. The oven according to claim 17, wherein said first nozzle being disposed above said fiber or web passing through said first opening, said second nozzle being disposed above said fiber or web passing through said second opening, said third nozzle being disposed below said fiber or web passing through said first opening, and said forth nozzle being disposed below said fiber or web passing through said second opening.

19. The oven according to claim 18, wherein a distance between said first nozzle and said third nozzle is 0.75 to 3 inches and a distance between said second nozzle and said forth nozzle is 0.75 to 3 inches.

20. The oven according to claim 1, further comprising a plurality of spaced apart air bars, adjacent air bars defining said openings therebetween.

21. The oven according to claim 20, wherein each air bar defines said air flow pathway.

22. The oven according to claim 20, wherein there are at least 7 air bars.

23. An oven according to claim 1, further comprising an air bar defining said air flow pathway, an air bar supply duct defining a supply air flow pathway and being in fluid communication with said air bar; and a frame, wherein said air bar is mounted in said frame, and said frame, air bar and air bar supply duct form an end subassembly adapted to be attached to said oven.

24. The oven according to claim 1, further comprising an air supply subassembly for supplying air from inside said oven chamber to said air flow pathway.

25. The oven according to claim 24, wherein said air supply subassembly includes a return duct for channeling air from inside said oven to an air seal supply fan, said air seal supply fan being provided for circulating said air from inside said oven to said air flow pathway.

26. The oven according to claim 1, wherein each nozzle has a proximal side inclined at an angle $\alpha$ from a vertical plane, said angle α being 45 to 85 degrees, and each nozzle has a distal side inclined at an angle β from a horizontal plane, said angle β being 30 to 60 degrees.

27. The oven according to claim 26, wherein said proximal side is hemmed to form a rounded tip.

28. The oven according to claim 26, wherein a tip of said proximal side and a tip of said distal side are spaced apart to form a gap having a gap width.

29. The oven according to claim 18, wherein said gap width is maintained with spacers.

30. The oven according to claim 1, wherein each air curtain is formed by air discharged at a rate of 500 to 5000 cubic feet per minute.

* * * * *

UNITED STATES PATENT AND TRADEMARK OFFICE

CERTIFICATE OF CORRECTION

PATENT NO. : 6,027,337

DATED : February 22, 2000

INVENTOR(S) : James H. Rogers, et al.

It is certified that error appears in the above-indentified patent and that said Letters Patent is hereby corrected as shown below:

Column 3, line 21, "±20°C" should be --±2°C--.

Column 6, line 1, "($co_2$)" should be --($CO_2$)--.

Column 13, line 55, after "oven" insert --adapted--. (claim 5)

Column 16, line 1, delete "18" and insert --28--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*